US006286158B1

(12) United States Patent
Lin

(10) Patent No.: US 6,286,158 B1
(45) Date of Patent: Sep. 11, 2001

(54) SHOWER HEAD ASSEMBLY

(76) Inventor: Mei-Kan Lin, No. 49, Tang Tung Erh Street, Ho Mei-Town, Changhua-Hsien (TW)

( * ) Notice: Subject to any disclaimer, the term of this patent is extended or adjusted under 35 U.S.C. 154(b) by 0 days.

(21) Appl. No.: 09/805,906

(22) Filed: Mar. 15, 2001

(51) Int. Cl.[7] ..... B05B 1/00
(52) U.S. Cl. ..... 4/601; 239/447; 239/449
(58) Field of Search ..... 4/601, 605, 615; 239/443, 447–449

(56) References Cited

U.S. PATENT DOCUMENTS 1,616,514 * 2/1927 Swimmer ..... 4/601
1,893,435 * 1/1933 Neal ..... 4/601
3,971,074 * 7/1976 Yxfeldt ..... 4/601
6,233,756 * 5/2001 Holbrook, Sr. ..... 4/601

* cited by examiner

*Primary Examiner*—Charles R. Eloshway
(74) *Attorney, Agent, or Firm*—Bacon & Thomas, PLLC

(57) ABSTRACT

A shower head assembly comprises a main shower head and a plurality of bent auxiliary shower heads wherein an adjusting mechanism of the main shower head is rotatable to divert water to spray from the nozzle of the main shower head in the form of streams of water or the nozzles of the auxiliary shower heads in the form of fine streams of water. This can provide an effect in addition to body cleaning.

1 Claim, 5 Drawing Sheets

SHOWER HEAD ASSEMBLY

FIELD OF THE INVENTION

The present invention relates to shower heads and more particularly to a shower head assembly consisting of a main shower head and a plurality of peripheral auxiliary shower heads in which an adjusting mechanism is operative to switch water flow between main shower head and auxiliary shower heads.

BACKGROUND OF THE INVENTION

A conventional shower head A is shown in FIG. 1 wherein water is sprayed in streams after being supplied through a flexible hose. As designed, the flow rate of water is controlled by turning a faucet. But this is unsatisfactory for the purpose for which the invention is concerned because the prior art can only provide a single function, i.e., body cleaning as to other purposes, such as massage, etc. are not available. Thus, improvement still exists.

SUMMARY OF THE INVENTION

It is an object of the present invention to provide a shower head assembly comprising a main shower head comprising a base including a longitudinal first bore, a hollow outer threaded section secured to and in communication with a pivotal flexible hose, a plurality of first recesses equally spaced around the first bore, and a plurality of first grooves each abutted the inner side of the first recess; an abutment mechanism including a longitudinal first bore, a circumferential recessed section on one side, a plurality of second recesses equally spaced around the second bore together with the first recesses for forming a plurality of circular holes, and a plurality of second grooves each abutted the inner side of the recess together with the first grooves for forming a plurality of circumferential grooves; an adjusting mechanism comprising an extended circumferential flange, a peripheral recessed portion between the extended circumferential flange and the adjusting mechanism, a sealing ring put on peripheral recessed portion, the extended circumferential flange and the sealing ring being received in the recessed section of the abutted mechanism, a projected sleeve having a staged outer surface in communication with the first and the second bores, and a circular recess on the side opposite to the extended circumferential flange; a shaft member comprising a stage-shaped head and an outer threaded end Inserted through the adjusting mechanism, the abutment mechanism, and the base to secure in the first bore, a third bore in communication with the bore of the outer threaded section, and a first channel in communication with the third bore; a diverting member received in the circular recess and having a plurality of second channels in communication with the first and the second bores, and a first nozzle having a plurality of first apertures in communication with the second channels; and a plurality of bent auxiliary shower heads each received in the circular hole and including a collar at one end received in the circumferential groove, two sealing rings on the top and the bottom sides of the collar respectively, a third channel, a second nozzle threadedly secured to the other end of the auxiliary shower head, and a block member having a plurality of blades for increasing the speed of water passing through the second nozzle; wherein the adjusting mechanism and the diverting member are operative to rotate to a first position so that the second channels are switched to be in communication with the first channel for directing water flowed from the hose through the first channel and the adjusting mechanism to spray in the first nozzle in the form of streams of water; and in a second position of the adjusting mechanism and the diverting member, the second channels are blocked from communicating with the first channel, thus redirecting water from the first channel through the recessed section and the auxiliary shower heads to spray in the second nozzle in the form of fine streams of water.

The above and other objects, features and advantages of the present invention will become apparent from the following detailed description taken with the accompanying drawings.

DETAILED DESCRIPTION OF THE PREFERRED EMBODIMENTS

Figure 1:
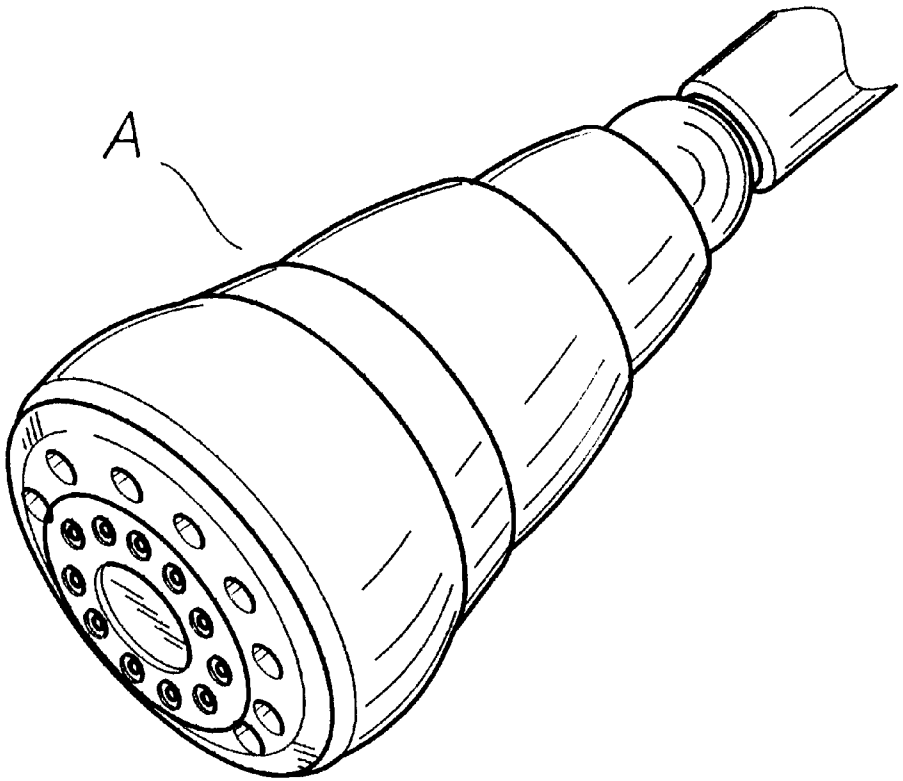
FIG. 1 PRIOR ART
FIG. 1 is a perspective view of a conventional shower head.
Figure 2:
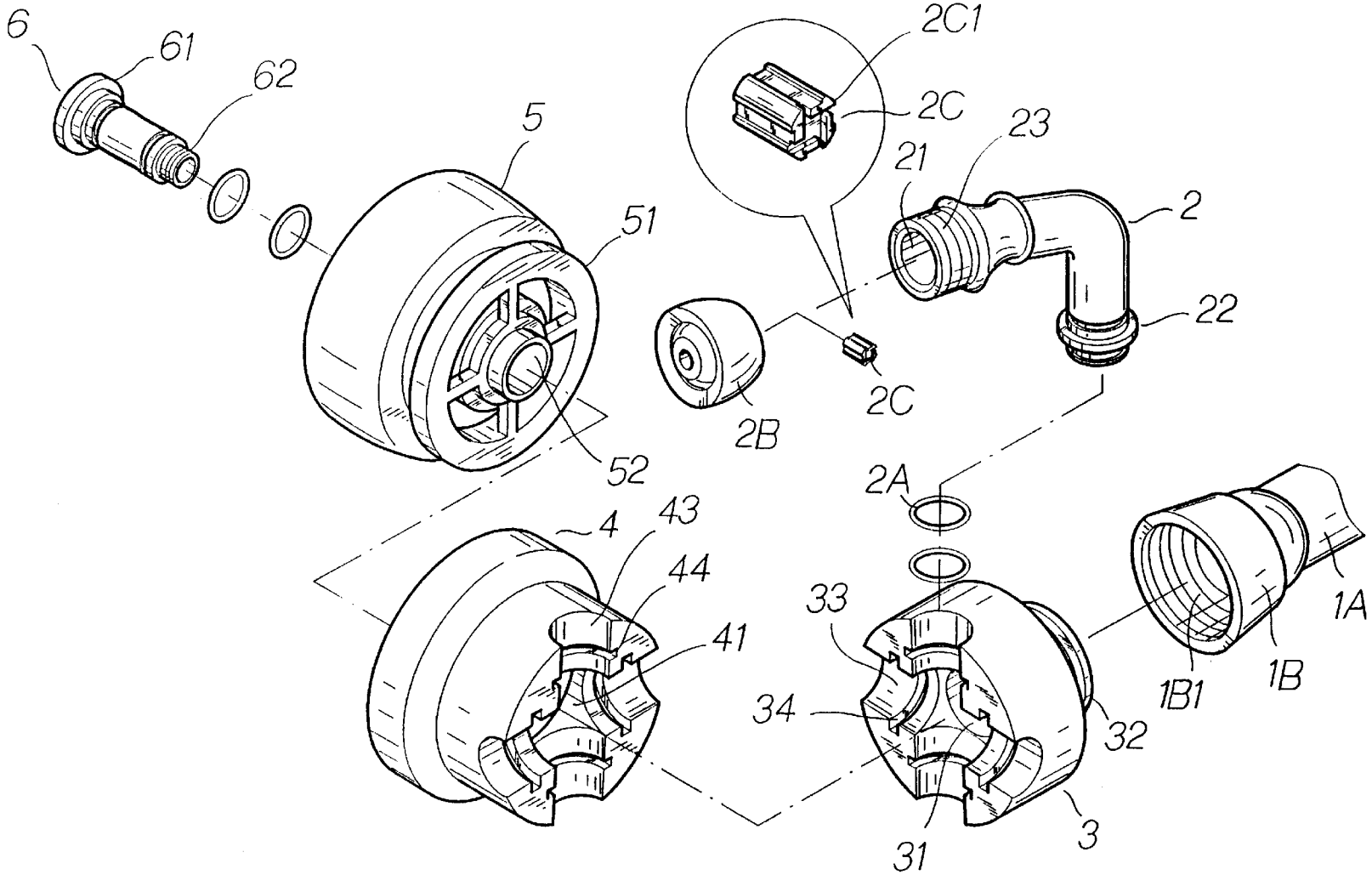
FIG. 2 is an exploded view of a preferred embodiment of shower head assembly according to the invention.
Figure 3:
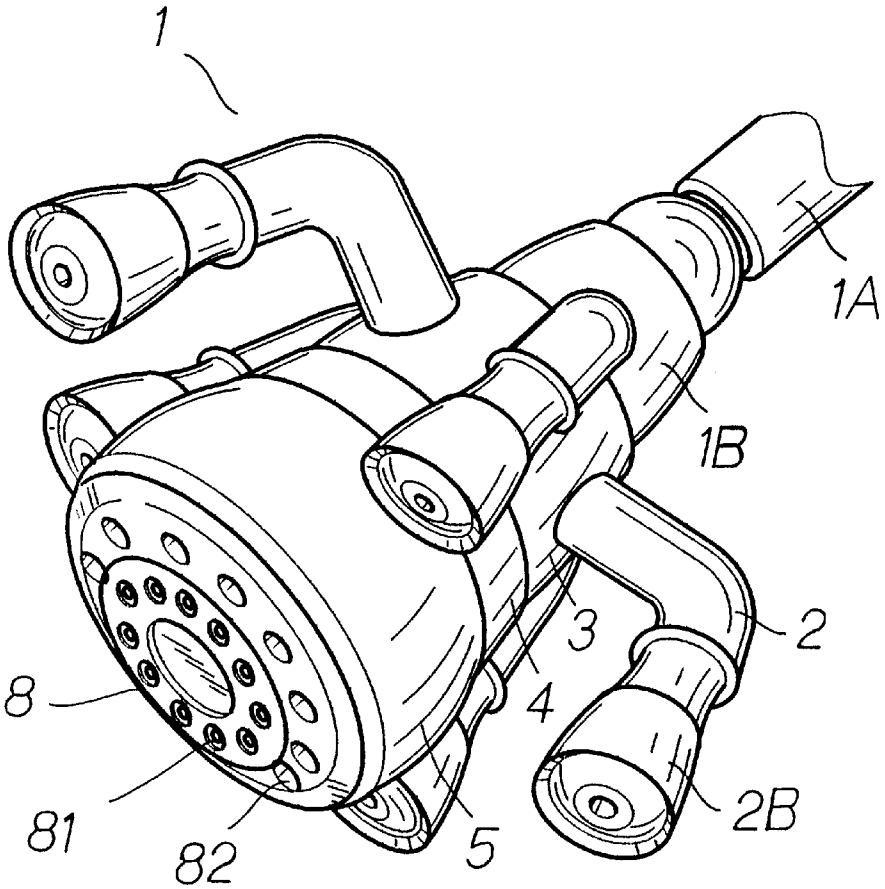
FIG. 3 is a perspective view of the assembled shower head assembly of FIG. 2.

Referring to FIGS. 2 and 3, there is shown a shower head assembly constructed in accordance with the invention comprising a main shower head 1 secured to a joint 1B which is pivotably coupled to a flexible hose 1A for adjusting the direction of shower head assembly, a plurality of auxiliary shower heads 2, a base 3, an abutment mechanism 4, an adjusting mechanism 5, a shaft member 6, a diverting member 7, and a nozzle 8. Each of above components is detailed below. Base 3 comprises a longitudinal bore 31 having an inner threaded section, an outer threaded section 32 secured to inner threaded section 1B1 of joint 1B, a plurality of smooth recesses 33 (four are shown) equally spaced around the bore 31, and a plurality of grooves 34 (four are shown) each abutted inner side of smooth recess 33. Abutment mechanism 4 comprises a longitudinal bore 41, a circumferential recessed section 42 on the side facing adjusting mechanism 5, a plurality of smooth recesses 43 (four are shown) equally spaced around the bore 41 together with smooth recesses 33 to form the plurality of circular holes, and a plurality of grooves 44 (four are shown) each abutted inner side of smooth recess 43 together with grooves 34 to form the plurality of circumferential grooves. Adjusting mechanism 5 comprises a circumferential flange 51 equally spaced from the body of adjusting mechanism 5, a plastic sealing ring 5A put on a circumferential groove between flange 51 and the body of adjusting mechanism 5, the flange 51 and sealing ring 5A being received in recessed section 42, a projected sleeve 52 having a staged outer surface in communication with bores 31 and 41, and a circular recess 53 on the side opposite to flange 51 Shaft member 6 comprises a stage-shaped head 61 and a projected shank having an outer threaded section 62 at the end inserted through adjusting mechanism 5, abutment mechanism 4, and base 3 to secure in bore 31, a bore 63 in communication with the bore of outer threaded section 32 which is in communication with hose 1A, and a channel 64 in the head 61 in communication with bore 63. Diverting member 7 is received in recess 53 and has a plurality of channels 71 in communication with bores 31 and 41. Nozzle 8 comprises a first plurality of apertures 81 arranged in an inner circle and a second plurality of apertures 82 arranged in an outer circle wherein the second apertures 82 are larger than the first apertures 81. Both apertures 81 and 82 are in communication with channels 71. Each auxiliary shower head 2 has a bent shape and is received in the circular hole (i.e., formed by recesses 33 and 43). Each auxiliary shower head 2 comprises a flange 22 in the substantially vertical section received in the corresponding grooves 34 and 44, two sealing rings 2A put on the substantially vertical section on top and bottom sides of flange 22 respectively, a through channel 21, an outer threaded section 23 in the substantially horizontal section, a nozzle 2B secured to the outer threaded section 23, and a block member 2C having a plurality of blades 2C1 for increasing the speed of water passing through nozzle 2B (i.e., fine streams of water).

Figure 4:
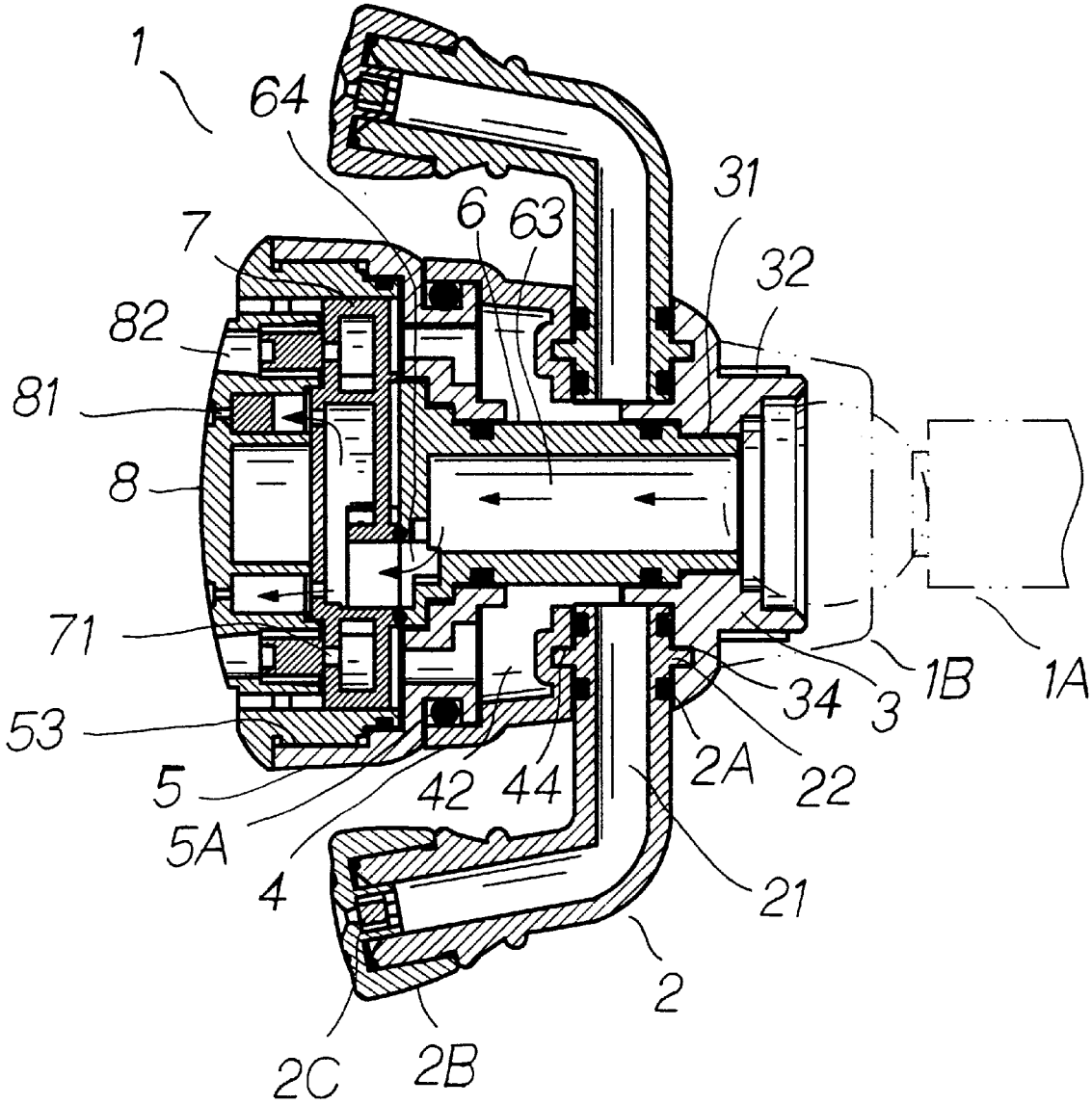
FIG. 4 is a sectional view of FIG. 3 where water is diverted to main shower head.

Referring to FIG. 4, adjusting mechanism 5 is rotated and accordingly the diverting member 7. In one position, channels 71 are switched to be in communication with channel 64. Thus water from channel 64 is directed to adjusting mechanism 5 and finally sprayed from apertures 81 and 82 in the form of streams of water. This can provide the function of body cleaning.

Figure 5:
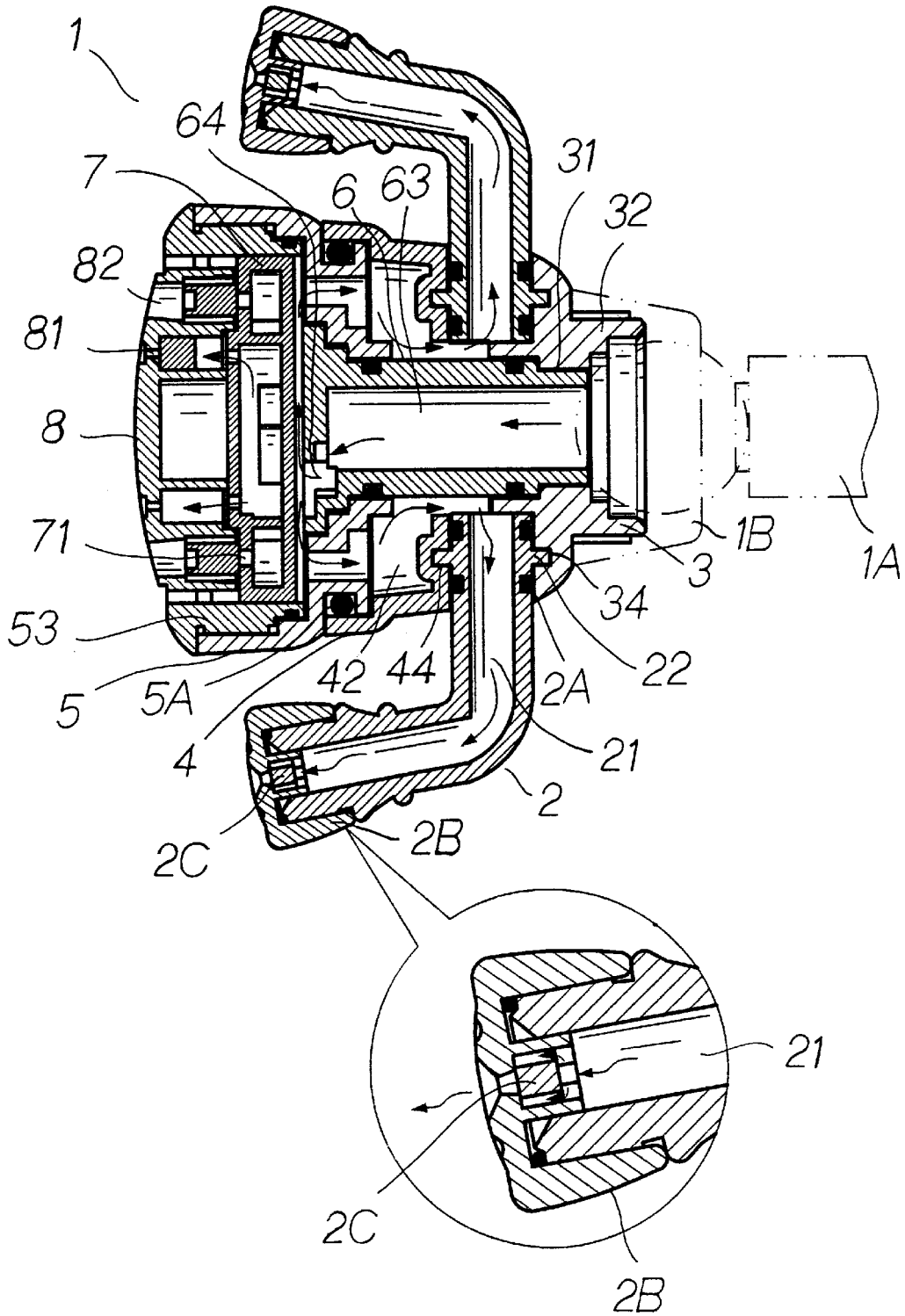
FIG. 5 is a view similar to FIG. 4 where water is diverted to auxiliary shower heads.

Referring to FIG. 5, adjusting mechanism 5 is further rotated and accordingly the diverting member 7. In another position, channels 71 are blocked from communicating with channel 64. Thus water from channel 64 is redirected to auxiliary shower heads 2 through recessed section 42. Finally water is sprayed from nozzle 2B in the form of fine streams of water. This can provide the function of massage or the like.

While the invention herein disclosed has been described by means of specific embodiments, numerous modifications and variations could be made thereto by those skilled in the art without departing from the scope and spirit of the invention set forth in the claims.

What is claimed is:

1. A shower head assembly comprising:

a main shower head comprising a base including a longitudinal first bore, a hollow outer threaded section secured to and in communication with a pivotal connector secured to a flexible hose, a plurality of first recesses equally spaced around said first bore, and a plurality of first grooves each abutting an inner side of each said first recess; an abutment mechanism including a longitudinal second bore, a circumferential recessed section on one side, a plurality of second recesses equally spaced around said second bore and aligned with said first recesses for forming a plurality of circular holes, and a plurality of second grooves each abutting an inner each said second recess and aligned with said first grooves for forming a plurality of circumferential grooves; an adjusting mechanism comprising an extended circumferential flange, a peripheral recessed portion between said extended circumferential flange and said adjusting mechanism, a sealing ring put on said peripheral recessed portion, said extended circumferential flange and said sealing ring being received in said recessed section of said abutment mechanism, a projected sleeve having a staged outer surface in communication with said first and said second bores, and a circular recess on a side opposite to said extended circumferential flange; a shaft member comprising a staged head and an outer threaded end inserted through said adjusting mechanism, said abutment mechanism, and said base to secure in said first bore, a third bore in communication with flexible hose, and a first channel in communication with said third bore; a diverting member received in said circular recess and having a plurality of second channels in communication with said first and said second bores, and a first nozzle having a plurality of first apertures in communication with said second channels; and a plurality of bent auxiliary shower heads each received in a respective circular hole and including a collar at one end received in a respective circumferential groove, two sealing rings, one above and one below said collar respectively, a third channel, a second nozzle threadedly secured to the opposite end of said auxiliary shower head, and a block member having a plurality of blades for increasing said speed of water passing through said second nozzle;

wherein said adjusting mechanism and said diverting member are operative to rotate to a first position so that said second channels are switched to be in communication with said first channel for directing water flowed from said hose through said first channel and said adjusting mechanism to spray through said first apertures in said first nozzle in the form of streams of water; and in a second position of said adjusting mechanism and said diverting member, said second channels are blocked from communicating with said first channel, thus redirecting water from said first channel through said circular recess and said auxiliary, shower heads to spray through said second nozzles in said form of fine streams of water.

* * * * *